US005271740A

United States Patent [19]

Endo et al.

[11] Patent Number: 5,271,740

[45] Date of Patent: Dec. 21, 1993

[54] CONNECTOR

[75] Inventors: Takayoshi Endo; Shigemitsu Inaba; Satoshi Yamada, all of Shizuoka, Japan

[73] Assignee: Yazaki Corporation, Tokyo, Japan

[21] Appl. No.: 984,856

[22] Filed: Dec. 3, 1992

[30] Foreign Application Priority Data

Dec. 3, 1991 [JP] Japan ..... 3-99519[U]
Mar. 23, 1992 [JP] Japan ..... 4-15083[U]

[51] Int. Cl.[5] ..... H01R 13/00
[52] U.S. Cl. ..... 439/637; 439/852
[58] Field of Search ..... 439/629-637, 439/852

[56] References Cited

U.S. PATENT DOCUMENTS 3,670,290 6/1972 Angele et al. ..... 439/637
4,371,228 2/1983 Chalmers ..... 439/637
4,431,252 2/1984 Cairns et al. ..... 439/637

FOREIGN PATENT DOCUMENTS 52-100989 7/1977 Japan .

*Primary Examiner*—Joseph H. McGlynn
*Attorney, Agent, or Firm*—Sughrue, Mion, Zinn, Macpeak & Seas

[57] ABSTRACT

In a connector comprising: a terminal having an electrically contacting spring piece which is accommodated in a surrounding wall in such a manner that it is allowed to protrude through an opening formed in the surrounding wall; and a connector housing into which the terminal is inserted, the spring piece has an electrically contacting portion confronted with the opening, and an slide portion bent in such a manner that it is away from the opening, and the connector housing has a depressing protrusion for depressing the slide portion. As the terminal is inserted into the connector housing, the depressing protrusion depresses the slide portion so as to cause the electrically contacting portion to protrude outside through the opening. Thus, the electrically contacting spring piece of the terminal is protectively held in the terminal until the latter is inserted into the connector housing.

5 Claims, 5 Drawing Sheets

CONNECTOR

BACKGROUND OF THE INVENTION

This invention relates to a connector which is engaged mainly with a circuit board connector.

FIGS. 13 and 14 shows a conventional connector of this type disclosed by Japanese Utility Patent Application No. 100989/1977 (the term "OPI" as used herein means an "unexamined published application").

As shown in FIGS. 13 and 14, the conventional connector 39 comprises: a terminal 30; and a connector housing 33 of synthetic resin which accommodates the terminal 30. The terminal 30 is made up of an electrical contacting spring piece 31 V-shaped in section, which is connected to a lead wire 32.

The connector housing 33 has an opening 35 in the upper wall to expose the spring piece 31 of the terminal 30. That is, upon insertion of the terminal 30 into the terminal accommodating chamber 36 of the connector housing 33, the spring piece 31 is allowed to protrude through the opening 35 as shown in FIG. 14. The spring piece 31 is brought into contact with a circuit terminal section 38 of a circuit board 37, so that the connector 39 is electrically connected to the circuit board 37.

The conventional connector thus constructed is disadvantageous in the following points: That is, since the spring piece 31 of the terminal 30 is held exposed at all times, it may be damaged or deformed by external force when the terminal 30 is pressure-connected to the lead wire before the terminal 30 is inserted into the connector housing 33 and/or when the terminal 30 is inserted into the connector housing 33.

SUMMARY OF THE INVENTION

Accordingly, an object of this invention is to eliminate the above-described difficulties accompanying a conventional connector.

More specifically, an object of the invention is to provide a connector comprising a terminal and a connector housing in which the electrically contacting spring piece of the terminal is protected from external interference until the terminal is inserted into the connector housing.

The foregoing object and other object of the invention has been achieved by the provision of a connector comprising: a terminal having an electrically contacting spring piece which is accommodated in a surrounding wall in such a manner that it is allowed to protrude through an opening formed in the surrounding wall; and a connector housing into which the terminal is inserted, in which, according to the invention, the spring piece has an electrically contacting portion confronted with the opening, and an slide portion bent in such a manner that the slide portion is away from the opening, and the connector housing has a depressing protrusion which, as the terminal is inserted into the connector housing, depresses the slide portion so as to cause the electrically contacting portion to protrude outside through the opening.

With the connector, until the terminal is inserted into the connector housing, the spring piece is protectively held in the surrounding wall. As the terminal is inserted into the connector housing, the depressing protrusion of the connector housing enters the surrounding wall while depressing the slide portion of the spring piece. As a result, the electrically contacting portion of the spring piece is caused to protrude outside through the opening, to be electrically connected to a mating terminal.

The nature, principle, and utility of the invention will be more clearly understood from the following detailed description of the invention when read in conjunction with the accompanying drawings.

DETAILED DESCRIPTION OF THE PREFERRED EMBODIMENTS

A connector, which constitutes a first embodiment of the invention, will be described with reference to FIGS. 1 through 7.

Figure 1:
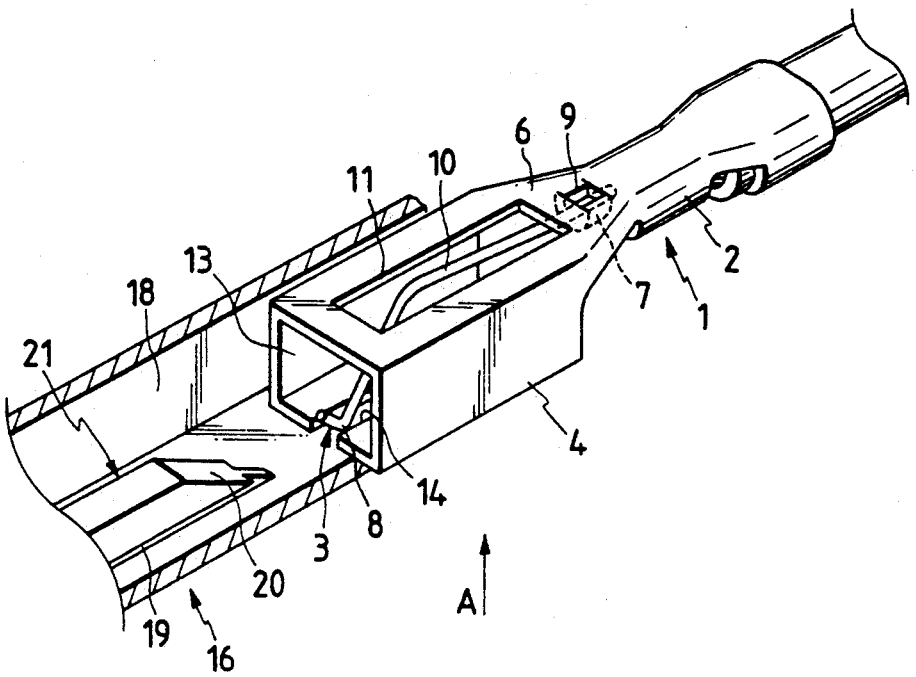
FIG. 1 is an exploded perspective view, with portions broken away for clarity, showing a connector, which constitutes a first embodiment of the invention.
Figure 2:
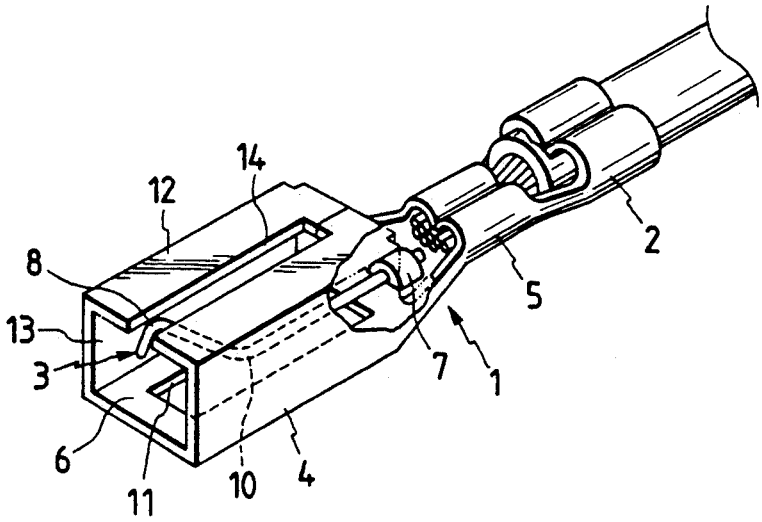
FIG. 2 is a perspective diagram of a terminal in the connector taken in the direction of the arrow A in FIG. 1.

As shown in FIGS. 1 and 2, the connector comprises: a terminal 1; and a connector housing 16, into which the terminal 1 is inserted. The terminal 1 is made up of a lead wire connecting portion 2 for clamping a lead wire, and a surrounding wall 4 extended from the lead wire connecting portion. The surrounding wall 4 is in the form of a pipe rectangular in section, and has an electrically contacting spring piece 3 disposed inside. The spring piece 3 is a V-shaped metal wire. The base end portion of the spring piece 3 is fixedly secured to a cut 7 by caulking which is formed in the rear end portion of the bottom 6 of the terminal in such a manner that the spring piece 3 is cantilevered to the terminal body 5. The free end portion of the spring piece 3 is formed into a V-shaped slide portion 8, and the remaining middle portion, into an electrically contacting bent portion 10. When the terminal 1 is left as it is, the spring piece 3 is protectively set inside the surrounding wall 4 which is in the form of a pipe rectangular in section.

The bottom portion 6 of the surrounding wall 4 has an opening 11 in front of the hole 9 of the cut 7 so that the electrically contacting bent portion 10 of the spring piece 3 can protrude through the opening 11. The top portion 12 of the surrounding wall 4 has a slit 14 which extends longitudinally from the edge of the front end opening 13 of the surrounding wall 4. Therefore, the electrically contacting bent portion 10 of the spring piece 3 is confronted with the opening 11 of the surrounding wall 4, while the slide portion 8 is confronted with the slit 14 being set away from the opening 11.

Figure 4:
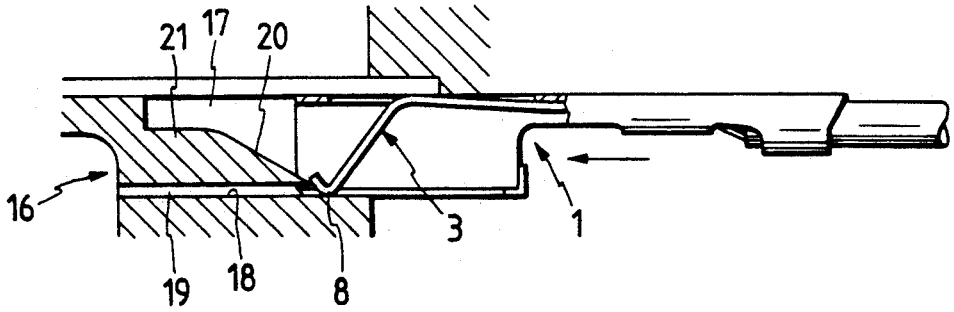
FIG. 4 is a longitudinal sectional view showing the terminal which is being inserted into the connector housing, corresponding to FIG. 1.

As shown in FIG. 1 or 4, the connector housing 16 has a terminal accommodating chamber 17. An insertion guiding protruded stripe 19 for the slit 14, and a spring piece depressing protruded stripe 21 for the slide portion 8 of the spring piece 3 of the terminal 1 are formed on the top wall 18 of the terminal accommodating chamber 17. The protruded stripe 21 has a sloped guide surface 20 at the front end.

Figure 3:
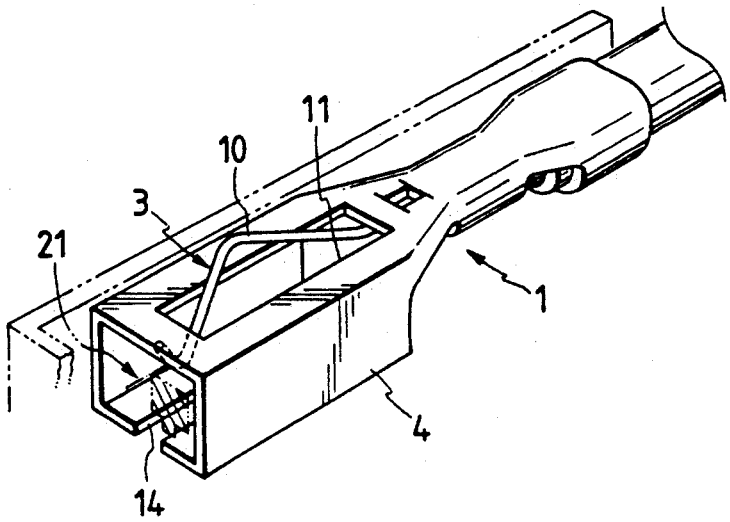
FIG. 3 is also a perspective diagram showing the terminal inserted in a connector housing.
Figure 5:
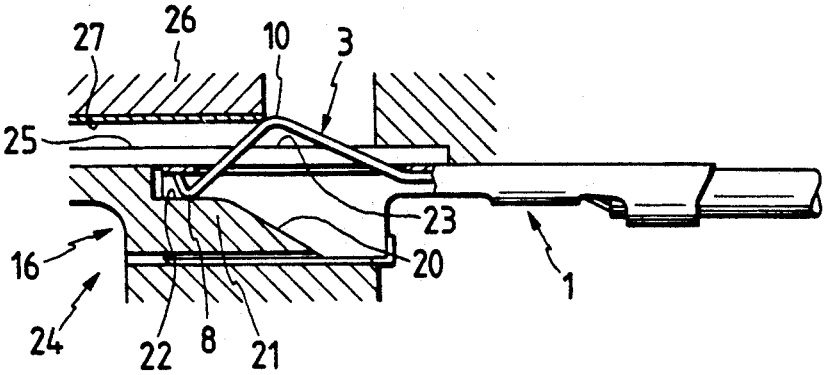
FIG. 5 is a longitudinal sectional view showing the terminal which has been inserted into the connector housing, corresponding to FIG. 3.

When the terminal 1 held as shown in FIG. 1 or 4 is inserted into the terminal accommodating chamber 17 of the connector housing 16, the depressing protruded stripe 21 is inserted into slit 14 defined by the surrounding wall 4 as shown in FIGS. 3 and 5, so that the slide portion 8 of the spring piece 3 is moved up the sloped guide surface 20 of the depressing protruded stripe 21 and set on the horizontal upper surface 22 of the latter 21, while the bent portion 10 of the spring piece 3 is protruded outside through the opening 11 of the terminal 1 and through the opening 23 of the connector housing 16.

Figure 6:
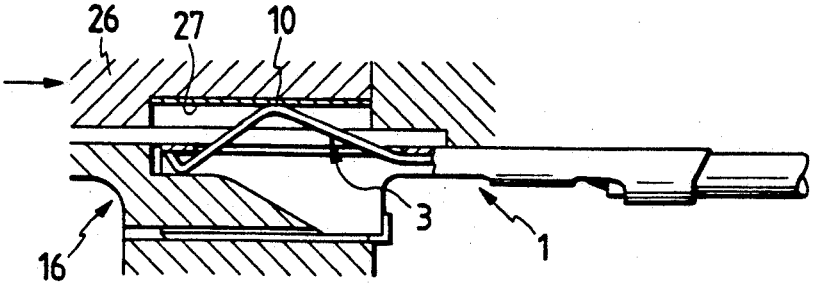
FIG. 6 is a longitudinal sectional view showing the connector engaged with a circuit board.
Figure 7:
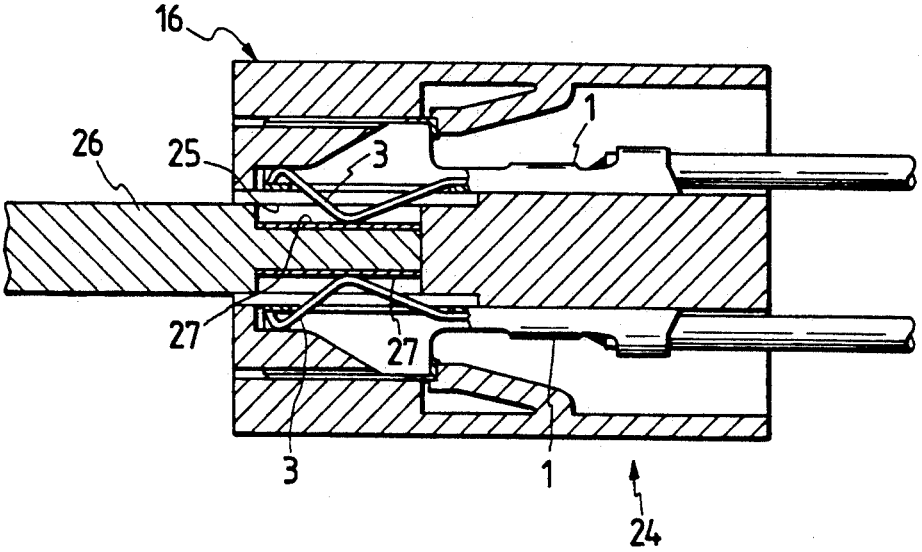
FIG. 7 is a longitudinal sectional view showing the entirety of the connector which has been engaged with the circuit board.

The opening 23 is communicated with a circuit board inserting groove 25 which is formed in the connector housing 16 at the middle. As shown in FIG. 7, a card edge type circuit board 26 is inserted into the space between a pair of spring pieces 3 and 3 which are protruded though the opening 23. so that, as shown in FIG. 6, too, the contacting bent portions 10 of the spring pieces 3 are brought into contact with circuit terminal sections 27 of the circuit board 26.

Figure 8:
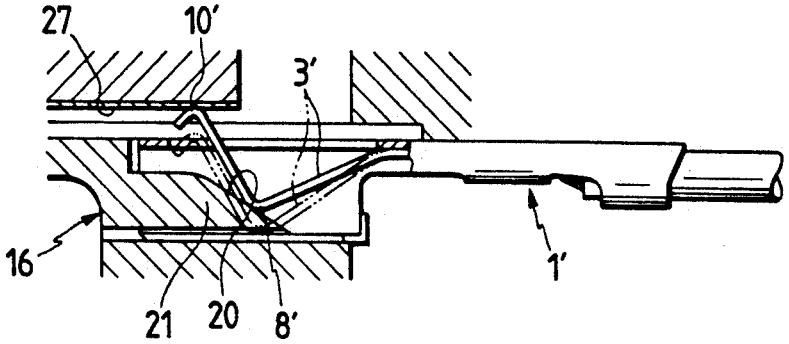
FIG. 8 is a longitudinal sectional view showing one modification of the terminal.

The above-described terminal may be modified as shown in FIG. 8.

In the modification, a terminal 1' has a spring piece 3' which is designed as follows: The middle portion of the spring piece 3' is formed into a slide portion 8', and the free end portion into an electrically contacting bent portion 10'. When the terminal 1' is inserted into a connector housing 16 which is similar to the connector housing of the above-described first embodiment, the slide portion 8' is moved up the sloped guide surface 20 of the spring piece depressing protruded stripe 21 so as to cause the contacting bent portion 10' to contact the circuit terminal section 27.

Figure 9:
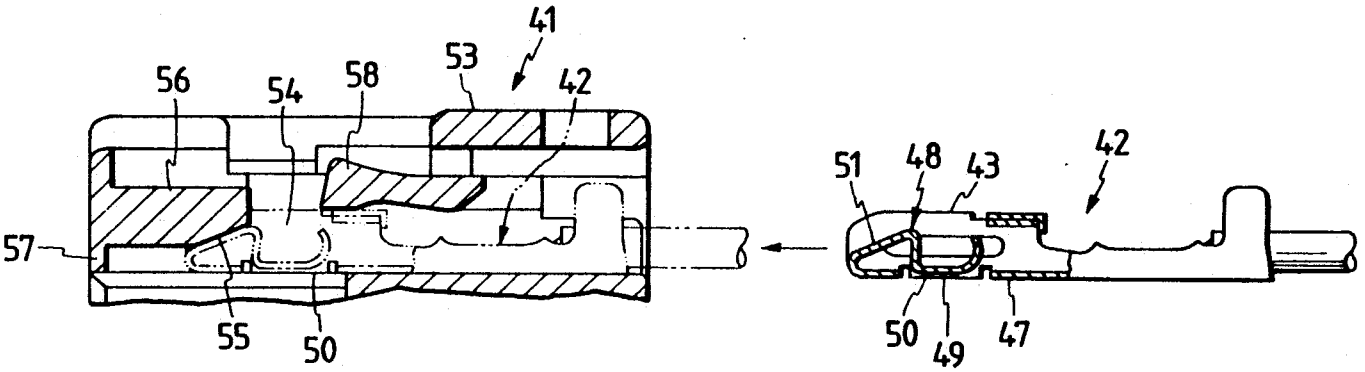
FIG. 9 is a longitudinal sectional view showing another example of the connector, which constitutes a second embodiment of the invention.
Figure 10:
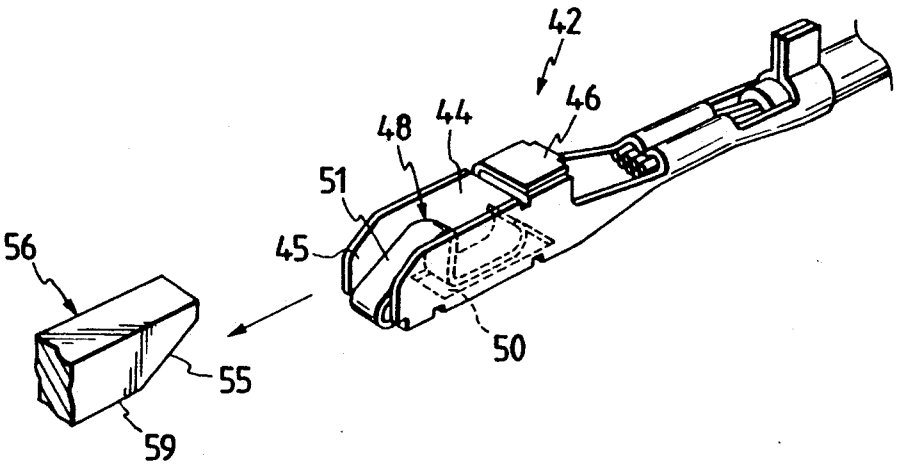
FIG. 10 is an exploded perspective view showing essential parts of the connector shown in FIG. 9.

Another example of the connector, which constitutes a second embodiment of the invention, is as shown in FIGS. 9 and 10.

The connector 41 shown in FIGS. 9 and 10 has a terminal 42 which is different in configuration from the terminal 1 of the first embodiment. That is, the terminal 42 is designed as follows: The terminal 42 has a surrounding wall 43 which is made up of a bottom plate, and two side plates, thus having a top opening 44 and a front opening 45. The rear end portion of the surrounding wall 43 is reinforced at the top with coupling pieces 46. A spring piece 48 having an electrically contacting portion 49 is extended from the bottom plate 47 of the surrounding wall, and an opening 50 is formed in the bottom plate 47 for receiving the electrically contacting portion 49.

The spring piece 48 includes: a sloped slide portion 51 which extends from the edge of the bottom plate 47 and bent obliquely backwardly; and the aforementioned electrically contacting portion 49 which is extended downwardly, towards the opening 50, from the top end of the sloped slide portion, and then bent along the bottom plate 47, thus confronting with the opening 50.

The connector further comprises a connector housing 53 having a terminal accommodating chamber 54, into which the terminal 42 is inserted. Similarly as in the case of the first embodiment, a spring piece depressing protruded stripe 56 having a sloped guide surface 55 is provided in the terminal accommodating chamber 54 in such a manner that it is extended longitudinally. More specifically, the spring piece depressing protruded stripe 56 is extended from the inner surface of a housing front wall 57 so as to allow its end portion to be inserted into the surrounding wall 43 of the terminal 42 through its front opening 45. The degree of inclination of the sloped guide surface 55 is substantially equal to that of the sloped slide portion 51 of the terminal 42, so that the terminal is smoothly inserted into the connector housing as indicated by the chain lines in FIG. 9. In FIG. 9, reference numeral 58 designates a flexible engaging piece for the terminal 42.

Figure 11:
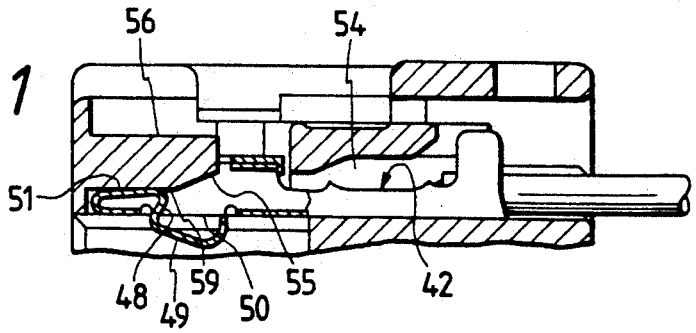
FIG. 11 is a longitudinal sectional view showing the connector with its terminal inserted into its connector housing.

FIG. 11 shows the terminal 42 which is further pushed into the connector housing 53 and set in the terminal accommodating chamber. In this operation, the slide portion 51 of the spring piece 48 of the terminal 42 is depressed by a horizontal lower surface 59 of the spring piece depressing protruded stripe 56 which surface merges with the sloped guide surface 55, so that the spring piece 48 of the terminal 42 is bent, and its electrically contacting portion 49 is exposed outside through the opening 50.

Figure 12:
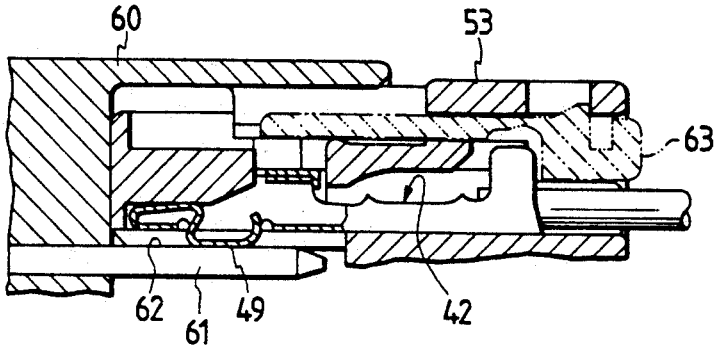
FIG. 12 is a longitudinal sectional view showing the connector engaged with a mating circuit board connector.
Figure 13:
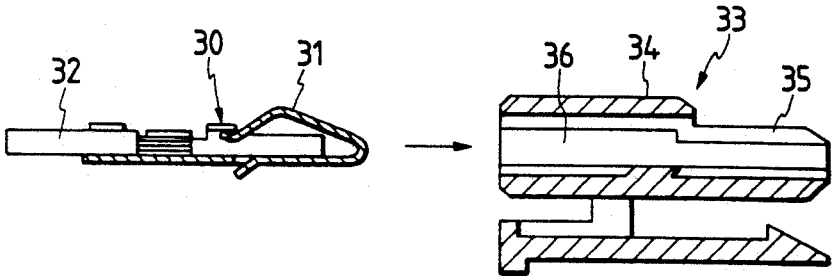
FIG. 13 is an exploded longitudinal sectional view showing a conventional connector comprising a terminal and a connector housing.
Figure 14:
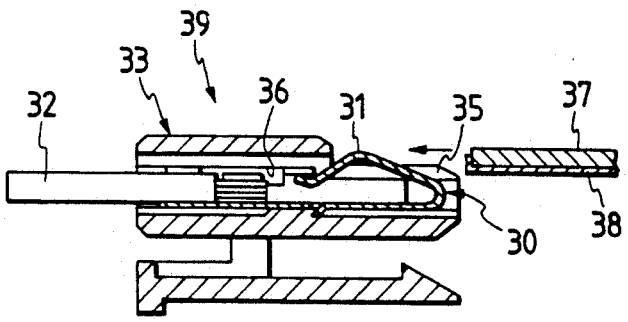
FIG. 14 is an exploded longitudinal sectional view showing the conventional connector with the terminal engaged with the connector housing.

FIG. 12 shows the connector coupled to a mating circuit board connector 60. The electrically contacting portion 49 of the terminal 42 is elastically brought into surface contact with the terminal section 61 of the substrate. In FIG. 12, reference numeral 63 designates a terminal locking member inserted into the connector housing from behind.

As is apparent from the above description, in the connector of the invention, the electrically contacting spring piece is not protruded outside as long as the terminal is not inserted into the connector housing; that is, insertion of the terminal into the connector housing causes the spring piece to protrude outside. Hence, for instance when the terminal is connected to a lead wire by clasping, or when it is inserted into the connector housing, the spring piece will never be damaged or deformed. Thus, the connector is considerably high in reliability when electrically connected.

While there has been described in connection with the preferred embodiments of this invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A connector comprising:

a terminal including a spring piece having an electrically contacting portion, and a surrounding wall defining a chamber in which said electrically contacting portion is accommodated, said wall defining an opening confronted with said electrically contacting portion;

a connector housing into which said terminal is to be inserted; and means for forcing said spring piece so that said electrically contacting portion protrudes outside said surrounding wall through said opening when said terminal is inserted into said connector housing.

2. The connector according to claim 1, wherein said spring piece is cantilevered to a body of said terminal.

3. The connector according to claim 1, said connector housing includes a circuit board inserting groove into which an edge of a printed circuit board is inserted so that said electrically contacting portion protruding outside said surrounding wall is electrically connected to a mating terminal section of said printed circuit board.

4. The connector according to claim 1, wherein said forcing means includes a slide portion provided on said spring piece, and a depressing protrusion provided on said connector housing for forcing said spring piece through said opening when said terminal is inserted into said connector housing.

5. The connector according to claim 4, wherein said depressing protrusion is formed with a sloped guide surface.

* * * * *